US007931090B2

(12) United States Patent
Smedstad et al.

(10) Patent No.: US 7,931,090 B2
(45) Date of Patent: Apr. 26, 2011

(54) SYSTEM AND METHOD FOR CONTROLLING SUBSEA WELLS

(75) Inventors: Eric Smedstad, Paris (FR); Rory MacKenzie, Sugar Land, TX (US); John Kerr, Sugar Land, TX (US); Randall A. Shepler, Sugar Land, TX (US); Rohitashva Singh, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 694 days.

(21) Appl. No.: 11/164,233

(22) Filed: Nov. 15, 2005

(65) Prior Publication Data

US 2007/0107907 A1 May 17, 2007

(51) Int. Cl.
*E21B 7/12* (2006.01)

(52) U.S. Cl. .. 166/366; 166/65.1; 166/54.1; 166/250.15

(58) Field of Classification Search ..... 166/338, 166/366, 368, 369, 250.15, 54.1
See application file for complete search history.

(56) References Cited

U.S. PATENT DOCUMENTS

| | | | | |
|---|---|---|---|---|
| 3,520,358 | A * | 7/1970 | Brooks et al. | 166/356 |
| 3,621,911 | A * | 11/1971 | Baker et al. | 166/336 |
| 3,633,667 | A * | 1/1972 | Falkner, Jr. | 166/366 |
| 3,643,736 | A * | 2/1972 | Talley, Jr. | 166/356 |
| 4,138,669 | A * | 2/1979 | Edison et al. | 340/3.51 |
| 4,309,734 | A * | 1/1982 | Warren | 361/58 |
| 4,378,848 | A * | 4/1983 | Milberger | 166/351 |
| 4,484,258 | A * | 11/1984 | Miller et al. | 700/12 |
| 5,048,914 | A * | 9/1991 | Sneddon | 385/53 |
| 5,097,780 | A * | 3/1992 | Winchester | 114/330 |
| 5,193,985 | A * | 3/1993 | Escue et al. | 417/53 |
| 5,256,844 | A * | 10/1993 | Grosvik et al. | 219/629 |
| 5,555,934 | A * | 9/1996 | Haufler | 166/68 |
| 5,834,721 | A * | 11/1998 | Østergaard et al. | 200/81 R |
| 6,045,333 | A * | 4/2000 | Breit | 417/44.1 |
| 6,102,673 | A * | 8/2000 | Mott et al. | 417/392 |
| 6,192,680 | B1 * | 2/2001 | Brugman et al. | 60/398 |
| 6,420,976 | B1 * | 7/2002 | Baggs et al. | 340/853.3 |
| 6,497,287 | B1 * | 12/2002 | Podio et al. | 166/370 |
| 6,505,691 | B2 * | 1/2003 | Judge et al. | 175/70 |
| 6,640,901 | B1 * | 11/2003 | Appleford et al. | 166/357 |
| 6,688,392 | B2 * | 2/2004 | Shaw | 166/366 |
| 6,725,924 | B2 * | 4/2004 | Davidson et al. | 166/250.01 |
| 6,873,063 | B1 * | 3/2005 | Appleford et al. | 307/149 |
| 6,877,557 | B2 * | 4/2005 | Richards et al. | 166/250.01 |
| 6,904,982 | B2 * | 6/2005 | Judge et al. | 175/213 |
| 7,011,152 | B2 * | 3/2006 | Soelvik | 166/65.1 |
| 7,080,996 | B2 * | 7/2006 | Ostergaard | 439/188 |
| 7,114,572 | B2 * | 10/2006 | Batho et al. | 166/370 |
| 7,123,162 | B2 * | 10/2006 | Mackenzie et al. | 340/854.7 |
| 7,152,682 | B2 * | 12/2006 | Hopper | 166/357 |

(Continued)

FOREIGN PATENT DOCUMENTS

EP 0027025 4/1981

(Continued)

*Primary Examiner* — Thomas A Beach
(74) *Attorney, Agent, or Firm* — Kevin Brayton McGoff; Rodney Warfford

(57) ABSTRACT

A technique is provided for control of subsea well systems. The technique utilizes a subsea controller coupled to a plurality of subsea well system components to allow localized control of the subsea well system. The subsea controller can be used in a variety of functional applications, such as balancing power distribution to subsea components.

25 Claims, 5 Drawing Sheets

U.S. PATENT DOCUMENTS

| | | | | |
|---|---|---|---|---|
| 7,185,705 | B2 * | 3/2007 | Fontana | 166/356 |
| 7,234,524 | B2 * | 6/2007 | Shaw et al. | 166/304 |
| 7,243,726 | B2 * | 7/2007 | Ohmer | 166/304 |
| 7,261,162 | B2 * | 8/2007 | Deans et al. | 166/336 |
| 7,422,066 | B2 * | 9/2008 | Rodrigues et al. | 166/341 |
| 2003/0153468 | A1 * | 8/2003 | Soelvik | 507/100 |
| 2004/0007392 | A1 * | 1/2004 | Judge et al. | 175/206 |
| 2004/0040707 | A1 * | 3/2004 | Dusterhoft et al. | 166/279 |
| 2004/0137773 | A1 * | 7/2004 | Ostergaard | 439/188 |
| 2005/0029476 | A1 * | 2/2005 | Biester et al. | 251/58 |
| 2005/0145388 | A1 * | 7/2005 | Hopper | 166/357 |
| 2006/0064256 | A1 * | 3/2006 | Appleford et al. | 702/31 |
| 2006/0096760 | A1 * | 5/2006 | Ohmer | 166/304 |
| 2007/0000667 | A1 * | 1/2007 | MacKenzie et al. | 166/345 |
| 2007/0173957 | A1 * | 7/2007 | Johansen et al. | 700/9 |
| 2009/0009931 | A1 * | 1/2009 | Rocke | 361/602 |
| 2009/0151956 | A1 * | 6/2009 | Johansen et al. | 166/350 |

FOREIGN PATENT DOCUMENTS

| | | | |
|---|---|---|---|
| GB | 2332220 | | 6/1999 |
| WO | WO-2004/003328 | A2 | 1/2004 |
| WO | 2004/016904 | * | 2/2004 |

* cited by examiner

SYSTEM AND METHOD FOR CONTROLLING SUBSEA WELLS

BACKGROUND

In the production of hydrocarbon based fluids, oil and/or gas bearing formations are located and wells are constructed by drilling wellbores into the formations. Appropriate fluid production or other well related equipment is deployed at each well. For example, electric submersible pumping systems can be deployed within each wellbore to produce fluid to a desired collection location.

Many such formations are located beneath the seabed, and well equipment must be moved to subsea positions at or within wellbores formed in the seabed. In many applications, the equipment is deployed at substantial depths and requires the transmission of electrical power over long distances to these subsea positions. The substantial power transmission distances can have a deleterious effect on the power actually delivered to subsea equipment.

With applications using subsea pumps, such as submersible pumps with electric submersible pumping systems and/or subsea booster pumps, the power requirements can be relatively high. Additionally, a wide variety of other well related devices may require power supplied from a surface location. The high power requirements combined with the long distances over which power must be transmitted effectively limits both the power delivered and the ability to optimize efficiency of operation with respect to the electric submersible pumping systems, subsea booster pumps and other powered components used in a given subsea production application.

SUMMARY

In general, the present invention provides a technique of controlling a subsea well system via a control system deployed at a subsea location to, for example, reduce latency effects found in conventional control systems. The subsea control system is deployed at a subsea location generally proximate the well system to be controlled. This enables local control of a variety of well system components including submersible pumps utilized with electric submersible pumping systems, subsea booster pumps, and a variety of other subsea components. The control system facilitates improved functionality with respect to a variety of process control functions, such as balancing power distribution between subsea components and enhancing closed loop control of the subsea well system.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to process control operations used in controlling various well equipment. The system and methodology applies process control technology to a subsea well via application of marinized process control equipment that can be positioned subsea at a location more proximate the well equipment of one or more subsea wells. For example, subsea process controllers can be used to control many types of subsea components, including one or more subsea pumps, e.g. subsea booster pumps or subsea submersible pumps used in electric submersible pumping systems. By locating the control system subsea, control of the well equipment is enhanced through, for example, reduction of latency effects otherwise found in traditional surface control systems and/or by facilitating closed loop control.

Figure 1:
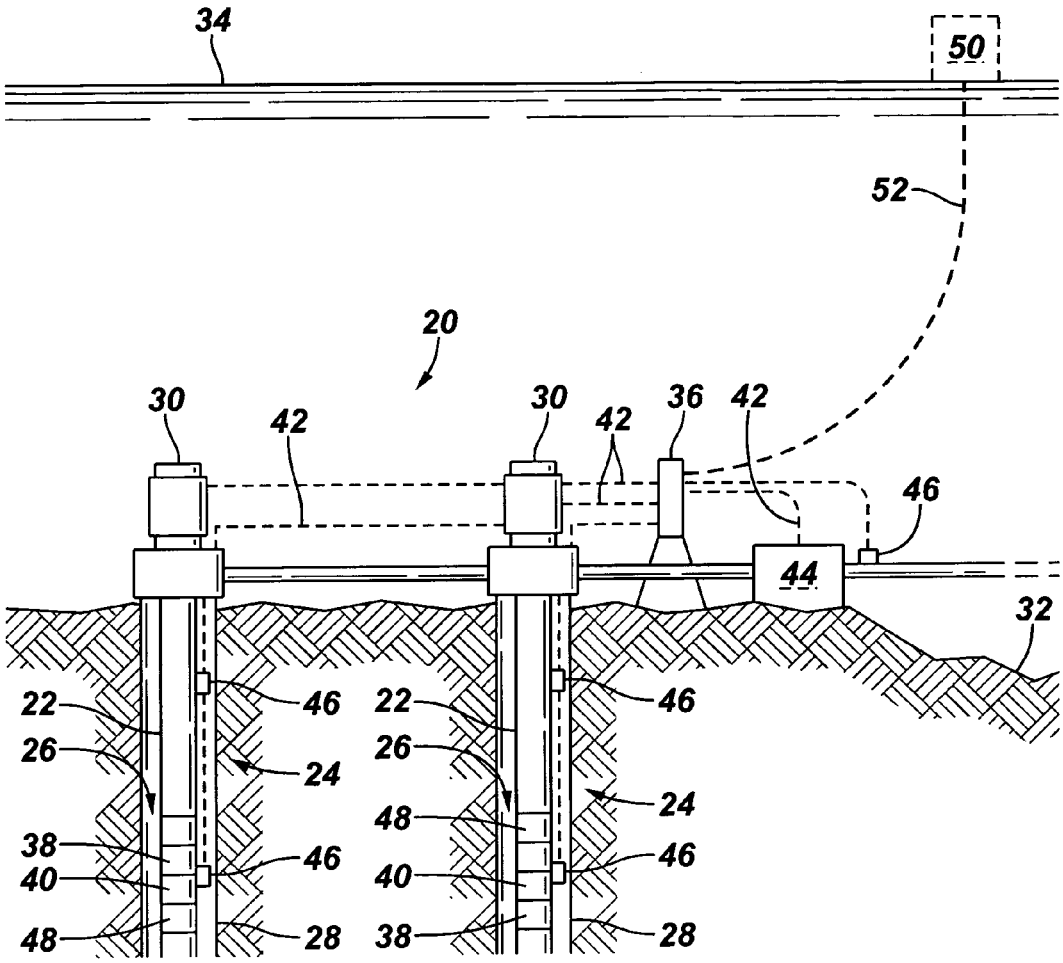
FIG. 1 is a front elevation view of a subsea well system, according to an embodiment of the present invention.

Referring generally to FIG. 1, a well system 20 is illustrated as comprising at least one completion 22 deployed for use in at least one well 24 having a wellbore 26 that may be lined with a wellbore casing 28. In the specific example illustrated, two wellbores 26 have been formed and each has at least one completion 22 deployed therein. Each completion 22 extends downwardly from a well tree 30 disposed at a seabed floor, often at a substantial depth relative to a surface location 34. A subsea control system 36 is deployed generally proximate the well site and is coupled to various subsea components of the well system. The subsea control system 36 is marinized to seal the internal components against seawater and thereby enable its sustained deployment at the submerged location.

In this embodiment, each completion 22 comprises at least one electric submersible pumping system 38 having a submersible pump 40. Subsea control system 36 is communicatively coupled to each electric submersible pumping system 38 by an appropriate communication line 42. Additionally, control system 36 may be coupled to a variety of other components. For example, the control system may be operatively coupled to a subsea booster pump 44 via an appropriate communication line 42. Also, control system 36 may be coupled to a plurality of sensor devices 46, examples of which include temperature sensors, pressure sensors, multi-phase flowmeters, fiber optic sensors, e.g. distributed temperature sensors or other fiber-optic pressure/temperature sensors, and other instrumentation devices. Sensor devices 46 also are coupled to subsea control system 36 via appropriate communication lines 42 and serve to enable closed loop control of the well system. Control system 36 also is adaptable to process control operations incorporating other devices 48 involved in many well system applications. Examples include in-well remotely controlled gas lift devices and choke devices.

As illustrated, subsea control system 36 is further coupled to a surface control 50 by a power and/or communication line 52. It should be noted that the communication lines can employ wired or wireless technologies for conveying signals.

Communication line 52 can be used to convey information related to the operation of well system 20 to a technician at the surface, or to convey new instructions or programming data to the subsea control system. In the illustrated embodiment, for example, subsea control system 36 is a solid-state control system, such as a processor based control system, that is readily programmed to carry out a variety of process control operations depending on the specific well system application. The processor based control system also is readily adaptable to monitor a wide variety of well parameters via, for example, sensor devices 46. Sensed data can be used by subsea control system 36 to form a closed loop control that enhances the process control operations over various subsea devices, including electric submersible pumping systems 38 and subsea booster pumps 44. The same or other sensed data also can be output to surface control 50.

The use of control system 36 at a subsea location generally proximate the devices being controlled enhances the process control system capabilities. For example, the localized subsea control system enhances the ability to balance power distribution between subsea components, particularly those components that have relatively high power requirements, such as electric submersible pumping systems and subsea booster pumps. The control system 36 provides, for example, load-balancing between two or more electric submersible pumping systems deployed in one or more wells. The control system also can be used for balancing loads between electric submersible pumps, between subsea booster pumps or between subsea booster pumps and electric submersible pumping systems. When pumps in a process system are connected in series, for example, there typically is an uneven distribution of load between pumps. Control system 36 provides a subsea processor that facilitates manual or automatic balancing, or selective mismatching, of the load on more than one pump. In other embodiments, the control system 36 can be used to manage loads on subsea pumps, such as those in electric submersible pumping systems 38, by controlling a tree choke (not shown) in the appropriate well tree 30. Regardless of the specific system design or specific approach to well control, subsea control system 36 enables better control and efficiency optimization of subsea pumps while providing the possibility for better protection for the overall subsea system 20 through closed loop control.

Figure 2:
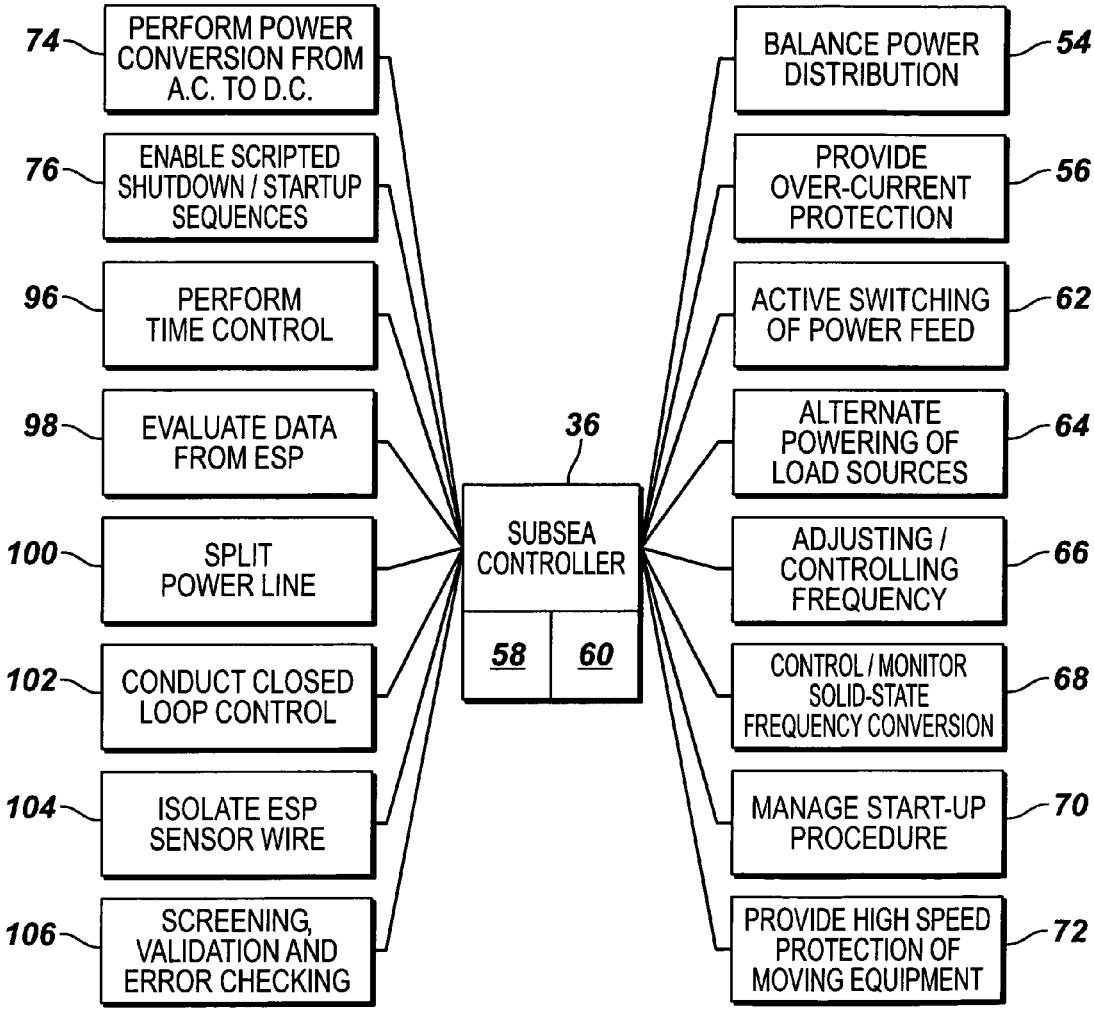
FIG. 2 is schematic illustration of a subsea control system utilized in the well system of FIG. 1, according to an embodiment of the present invention.

By providing a processor based subsea control system 36, a wide variety of functionality is easily programmed into the control system. This enables use of the control system 36 in many types of process control operations in subsea wells. Referring to FIG. 2, for example, the subsea controller 36 has many functional capabilities depending on the specific subsea well system 20 in which it is used.

As discussed above, subsea control system 36 can be used to balance power distribution between subsea components, as illustrated by block 54. In many applications, high power devices, e.g. subsea pumps, are used to pump hydrocarbon based fluids. However, the substantial distance from surface location 34 to the well site at seabed floor 32 often effectively limits delivered pump power and also can hinder the ability to optimize pump efficiency. The use of subsea controller 36 greatly facilitates the management of available power and the optimization of system efficiency.

However, control system 36 can be used in many other types of process control operations. For example, control system 36 can be used to provide over-current protection or other electrical protection, e.g. an open circuit, as illustrated by block 56. The control system utilizes and controls a high speed switch 58 at a subsea location to provide over-current protection and effectively act as a subsea circuit breaker. Additionally, control system 36 may comprise or cooperate with a solid-state switching power supply 60, e.g. a subsea variable frequency drive, to provide load control between electric submersible pumping systems and/or other subsea pumps via the active switching of a surface fed subsea power supply, as illustrated by block 62. In a related process control operation, control system 36 can be used to alternately power load sources, as illustrated by block 64. In one example, the control system 36 performs subsea electrical power switching and provides electrical power protection for an electrical load, such as a heating circuit.

In other process control operations, subsea control system 36 can be used to adjust and control the power signal frequency, as illustrated by block 66. The control system 36 also can be used to control or monitor a solid-state frequency conversion device, such as a silicon controlled rectifier (SCR), as illustrated by block 68. The subsea controller further can be used to manage startup and/or shut down sequences of subsea components, such as electric submersible pumping systems, as illustrated by block 70. The efficient use of such components can be optimized further by reprogramming the processor based control system or by interchanging the processor via, for example, a remotely operated vehicle, as discussed in greater detail below.

High speed protection of moving equipment also can be provided by a properly programmed subsea controller 36, as illustrated by block 72. The use of local algorithms on subsea controller 36 integrated with subsea instrumentation, e.g. sensors, can be used to prevent the occurrence of damage in many applications. For example, if an electric submersible pumping system is operating, subsea control system 36 can be programmed to maintain subsea well valves in an open position so as not to block the flow of production fluid. Upon initiation of a shutdown sequence via input from, for example, surface control 50, the electric submersible pumping system can first be brought to a stop before the closing of valves in the corresponding tree 30.

Other process control operations performed by subsea controller may include the conversion of power from alternating current power to direct current power using, for example, silicon controlled rectifiers, as illustrated by block 74. Accordingly, power can be delivered subsea in alternating form and converted for use in powering subsea direct current loads, e.g. subsea trees and/or subsea electrolyzers. The use of a processor based controller also enables the use of remotely configurable scripts that can be sent from, for example, surface control 50 to subsea control system 36 to make adjustments to the control exercised by subsea controller 36, as illustrated by block 76. By way of example, if data obtained at the surface from a multi-phase flow meter indicates the production of excessive gas, this may be an indication the electric submersible pump system is losing efficiency. Appropriate commands can then be downloaded to subsea controller 36, such that its control regime is changed to reduce electric submersible pumping system input power when excessive gas is detected in the produced fluid.

Figure 3:
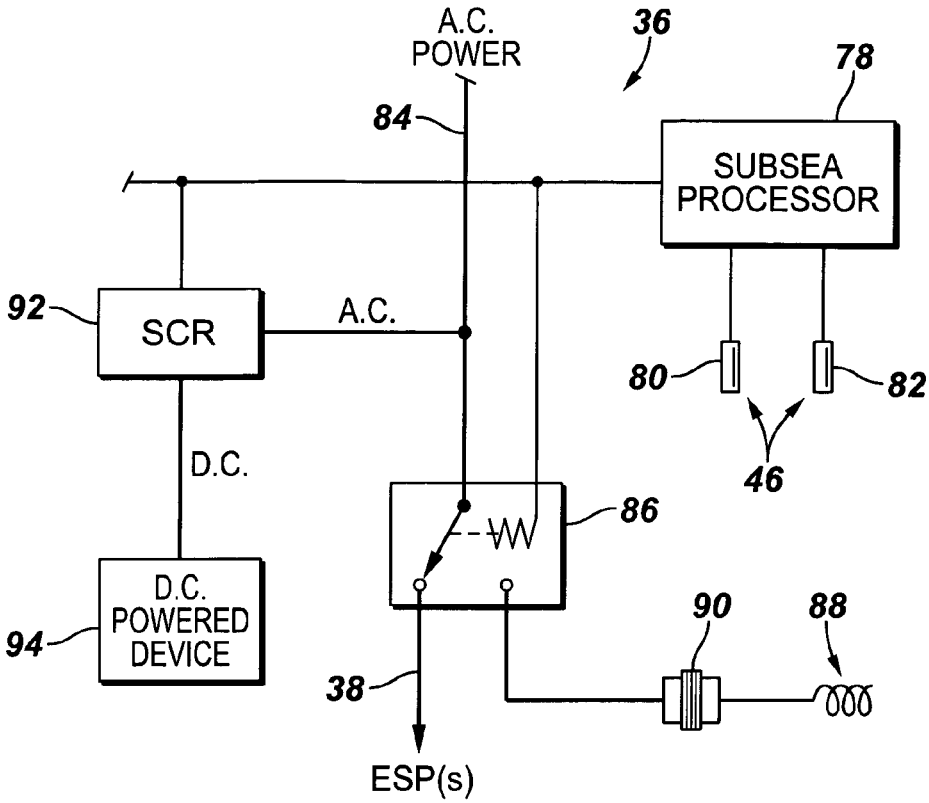
FIG. 3 is a schematic illustration of one application of a subsea control system, according to an embodiment of the present invention.

By way of further example, a command signal may be sent from the surface, e.g. surface control 50, to subsea control system 36 to initiate a startup procedure by diverting alternating current power to a transformer heating circuit. As illustrated in FIG. 3, subsea control system 36 comprises a subsea processor 78 able to receive programming commands or other command signals from the surface location. Additionally, subsea processor 78 is coupled to sensor devices 46 to receive well system data from the sensor devices, e.g. temperature sensors 80 and pressure sensors 82. In this embodiment, alternating current (AC) power is supplied by a power line 84, and subsea processor 78 controls actuation of a switch 86 that can be used to switch AC power between an electric submersible pumping system 38 and a heater 88 via transformer 90. Thus, subsea processor 78 may receive and process a command signal sent from the surface to adjust the startup procedure and to initially divert AC power to heater 88. Once the temperature input reaches a threshold value representing a viscosity set point, switch 86 can be actuated via processor 78 to switch the AC power from heater 88 to the one or more electric submersible pumping systems 38. Temperature sensor 80, for example, can be used to provide feedback to subsea processor 78 as to the temperature of the fluid heated by heater 88.

In this particular example, subsea control system 36 further comprises silicon controlled rectifiers 92 that enable conversion of AC power to direct current (DC) power. The AC power supplied by power line 84 is fed to silicon controlled rectifiers 92 which are controlled by a subsea processor 78. Thus, DC power may selectively be supplied to one or more DC power devices 94 as controlled by subsea processor 78.

Returning to the functionality of subsea control system 36, as illustrated in FIG. 2, subsea control system 36 also can be used to perform tree control, as illustrated by block 96, and to evaluate different types of data obtained from sensor devices 46, as illustrated by block 98. For example, sensors along electric submersible pumping systems 38 can provide a wide variety of data related to fluid production, and this data can be used by control system 36 to adjust the operation of the pumping systems.

The subsea control system 36 also can be used to split a single power line into two or more separate power lines, as illustrated by block 100. In one example, control system 36 is used to split a single power line to power two or more electric submersible pumping systems while monitoring operation of the pumping systems and controlling power distribution between the systems. This enables a reduction in subsea power lines, thereby substantially reducing costs associated with running multiple lines. In this application and in many other applications, controller 36 can be used to optimize operation of the system by monitoring a variety of instrumentation and establishing a closed loop control, as illustrated by block 102.

Additionally, when electric submersible pumping system sensor data is output to a seabed location, a separate path other than the power line can be used. In this application, an electric submersible pumping system sensor wire (or I-wire) can be isolated by the subsea control system 36, as illustrated by block 104. This ensures the high-voltage/power from the electric submersible pumping system is not accidentally transmitted along the I-wire. Further isolation of the I-wire can be obtained by using an electrical sensor-to-optic communication conversion. In other applications, however, electric submersible pump system data is transmitted to surface using a communications-on-power link. In this latter embodiment, subsea control system 36 can be used to perform screening, validation and error checking of the data prior to integration with other data subsequently transmitted to a surface location, e.g. surface control 50, as illustrated by block 106. The subsea control system can obtain the electric submersible pumping system data from the power line through a separate gauge wire from an electric submersible pumping system data logger or by use of an inductive coupler to acquire communications data from the power line at a subsea location.

Figure 4:
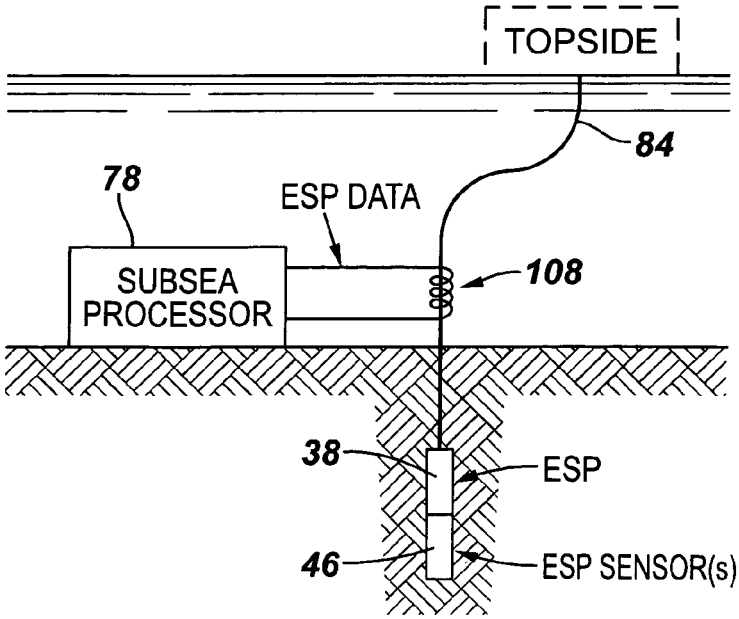
FIG. 4 is a schematic illustration of another application of a subsea control system, according to an embodiment of the present invention.

The latter approach for obtaining electric submersible pumping system data is illustrated in FIG. 4. As illustrated, sensor devices 46 are deployed to sense well parameters related to operation of one or more electric submersible pumping systems 38. The data is sent to a surface location, e.g. surface control 50, on power line 84 via, for example, a communication-on-power data transmission technique. In many applications, it is useful to also supply this data to subsea processor 78 of subsea control system 36 as feedback without directly exposing control system 36 and subsea processor 78 to power line 84. Accordingly, an inductive coupler 108 is coupled to power line 84 and subsea processor 78. This enables subsea processor 78 to obtain electric submersible pumping system data output by sensor devices 46 without direct exposure to power line 84.

Figure 5:
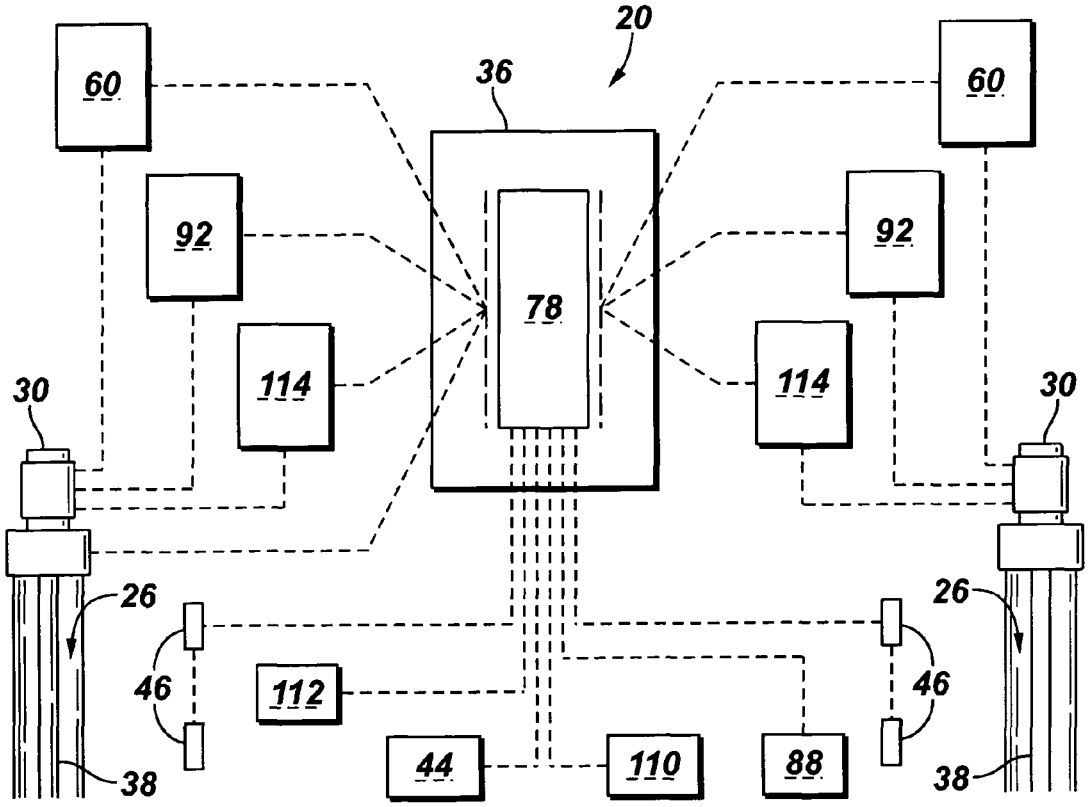
FIG. 5 is a schematic illustration of an overall subsea well system, according to an embodiment of the present invention.

As illustrated schematically in FIG. 5, well system 20 can utilize subsea control system 36 in carrying out process control operations related to a wide variety of power consumers, e.g. controllable subsea devices, used in well operations for one or more wellbores 26. Some of those controllable devices have been described above, and include electric submersible pumping systems 38 and subsea booster pumps 44. Many other devices also can be controlled by control system 36, such as in-well remotely controlled gas lift devices 110, well trees 30, a wide variety of valves, including chokes 112, heating devices 88 and other controllable devices used in subsea well applications. Additionally, subsea control system 36 can be coupled to a wide variety of instrumentation to facilitate the monitoring of well activity. The instrumentation can include many types of sensor devices 46, and the schematically illustrated sensor devices 46 of FIG. 5 are representative of those many types of devices. Depending on the specific well application, sensor devices 46 may include electric submersible pumping system sensors deployed internally or externally, pressure sensors, temperature sensors, multiphase flow meters, fiber optic sensors, distributed temperature sensors and other types of instrumentation to monitor well conditions and/or provide feedback to control system 36 to enable closed loop control over the well operations. In other words, sensor inputs are used to manage pump operation. Examples of sensor inputs include flow rate, temperature, viscosity, sand rate, vibration and pressure.

Additionally, subsea control system 36 can be constructed in a variety of forms with various functional capabilities. In the embodiment illustrated, control system 36 comprises subsea processor 78. However, control system 36 also may comprise or be operatively engaged with a variety of other control related devices, including many types of solid-state switches 114, silicon controlled rectifiers 92 and variable frequency drives 60. In any of the potential configurations, the overall subsea control system 36 is marinized to enable long-term deployment at subsea locations.

Figure 6:
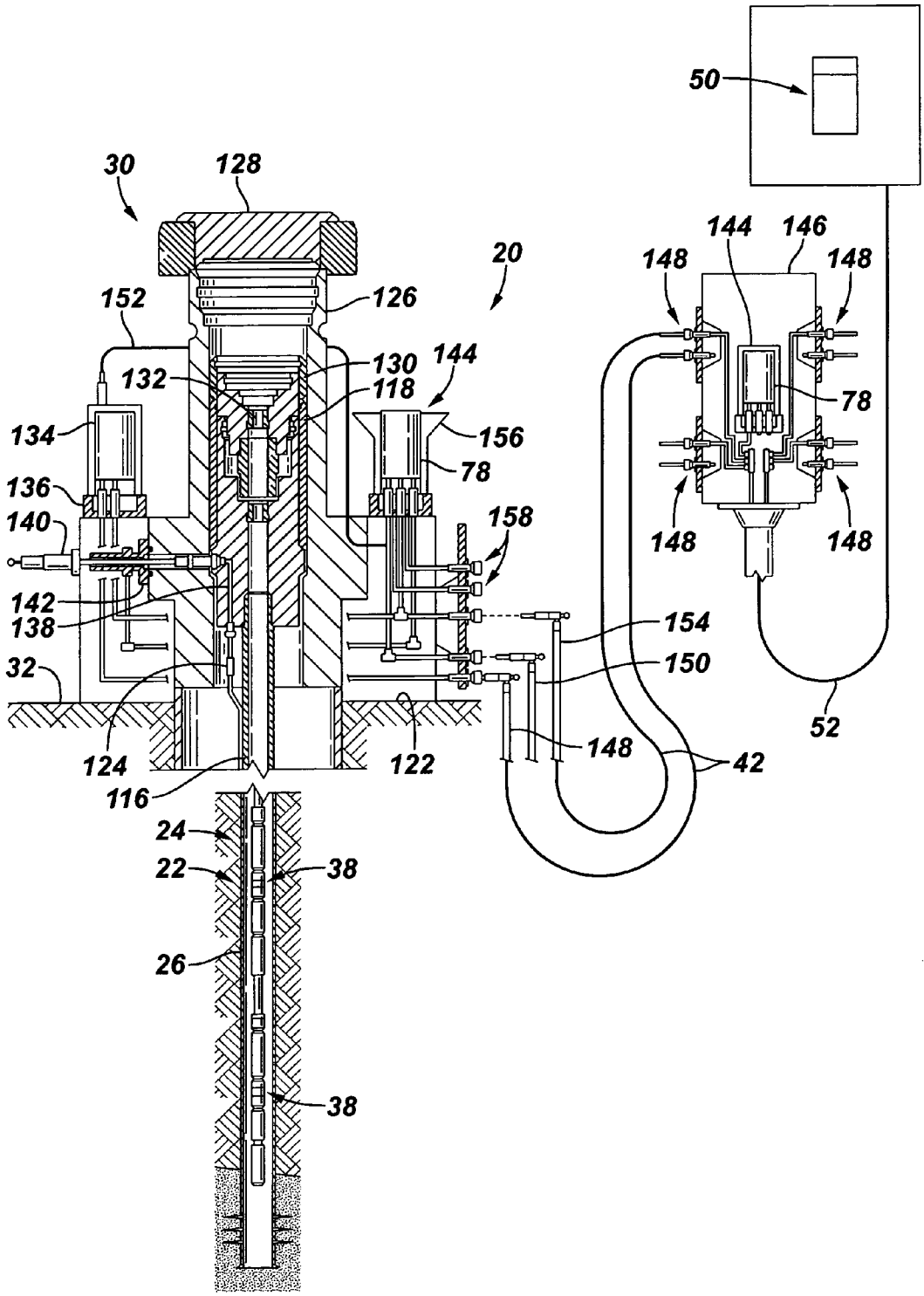
FIG. 6 is front elevation view of a subsea pumping system controlled by a subsea control system, according to an embodiment of the present invention.

A more detailed example of one embodiment of an overall well system 20 is illustrated in FIG. 6. In this example, system 20 comprises a subsea well with a horizontal tree system. As illustrated, subsea well system 20 comprises two electric submersible pumping systems 38 deployed in a single wellbore 26 on production tubing 116 suspended from a tubing hangar 118. Tubing hangar 118 is deployed within a well tree 30 at seabed floor 32. In this embodiment, tree 30 comprises a tree body having a base 122 with a splice 124. Additionally, tree 30 comprises a midsection 126 connected between base 122 and a tree cap 128. An internal tree cap 130 is deployed within midsection 126 along with a crown plug 132.

Additionally, a subsea control module 134 with a production control system may be coupled to tree 30 by an active base connector 136. In the illustrated embodiment, a combined fiber optic plug and communication line 138 is coupled with a remotely operated vehicle interface 140 via a fiber optic wellhead outlet 142. The communication line extends, for example, downwardly into well bore 26 for carrying signals to and/or from first and second electric submersible pumping systems 38 and/or sensor devices deployed along the wellbore.

As illustrated, subsea control system 36 is deployed proximate the well site. By way of example, this embodiment of subsea control system 36 may comprise one or more subsea data hubs 144, each having at least one processor 78 or signal conversion device therein. For example, a data hub may provide signal conversion from electrical to optical signals such that another data hub or another portion of the data hub does the actual data processing. Subsea data hub 144 may be a manifold mounted subsea data hub deployed within a manifold 146 separate from the well tree 30; subsea data hub 144 may be mounted to the well tree 30; and/or a plurality of subsea data hubs may be mounted within manifold 146 or on tree 30. The overall subsea control system 36 may be designed such that each subsea data hub performs as an alternate control, a redundant control, or as cooperative components of the overall control system 36.

Manifold 146 may comprise a plurality of sensor or data interface points 148 by which processor 78 is operatively coupled with one or more well trees 30 or other well or subsea equipment, e.g. booster pumps, heating coils and/or electric trees. Each interface member 148 enables the coupling of communication lines between processor 78 and various components of well system 20. Additionally, manifold 146 is connected to surface control 50, e.g. a top side data hub, via communication line 52 which may comprise power line 84 (see FIG. 3) and/or various other communication lines. In the embodiment illustrated, one interface member 148 (see FIG. 6) is associated with the well tree 30 and facilitates the transfer of, for example, communication on power signals to the subsea control module 134 via communication line 148. Additionally, communication and/or power signals can be communicated independent of subsea control module 134 via, for example, a communication line 150. Alternatively, communications between processor 78 and subsea control module 134 can be communicated over a copper communication line 152. Also, a variety of communication signals can be communicated between processor 78 of subsea control system 36 and the various subsea components via one or more additional communication lines, e.g. fiber optic communication lines 154.

If an alternate subsea data hub 144 or an additional subsea data hub 144 is mounted to tree 30, the same types of communication lines can be used for communication with well system components and/or other data hubs. In the embodiment illustrated, processor 78 is deployed in a subsea data hub 144 and received in a data hub receptacle 156 mounted on well tree 30, such as on a top side of base 122. Also, additional interfaces 158 may be mounted to well tree 30 and communicatively coupled to one or more of the subsea data hubs 144. The interfaces 158 comprise, for example, interfaces for coupling with other well systems or well system components, e.g. an intelligent well system interface. In some applications, the subsea data hubs may be interchanged with different subsea data hubs by a remotely operated vehicle.

The well system illustrated in FIG. 6 is but one example of the many potential arrangements of both control system 36 and overall well system 20. The marinized control system 36 located generally proximate a subsea well site enhances the ability to implement a wide variety of subsea process control operations. The specific components selected for the well system, including control system 36, can vary from one application to another and from one subsea environment to another.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A subsea well system, comprising:

a plurality of pumps deployed in a subsea environment; and a processor based control system coupled to the plurality of pumps and deployed at a subsea location, wherein the processor based control system automatically controls balancing of power distribution between the plurality of pumps at the subsea location.

2. The subsea well system as recited in claim 1, wherein the plurality of pumps comprises at least one submersible pump of an electric submersible pumping system.

3. The subsea well system as recited in claim 1, wherein the plurality of pumps comprises at least one subsea booster pump.

4. The subsea well system as recited in claim 1, wherein the processor based control system is coupled to the plurality of pumps in a closed loop control system.

5. The subsea well system as recited in claim 1, further comprising a plurality of sensors positioned to sense pumping related parameters, the plurality of sensors being coupled to the processor based control system to provide feedback to the control system.

6. The subsea well system as recited in claim 1, wherein the processor based control system comprises an electrical power protection system.

7. The subsea well system as recited in claim 1, wherein processor based control system is constructed as a subsea data hub mountable on a subsea well tree.

8. The subsea well system as recited in claim 1, wherein the processor based control system comprises a subsea variable frequency drive.

9. The subsea well system as recited in claim 1, wherein the processor based control system provides load-balancing between the plurality of pumps and a subsea device.

10. The subsea well system as recited in claim 6, wherein the processor based control system performs subsea electrical power switching and provides electrical power protection for an electrical load.

11. A method of controlling subsea operations, comprising:

forming a marinized process control system with a solid-state, processor based control;

deploying the marinized process control system at a subsea location;

connecting the solid-state, processor based control to a plurality of sensors; and applying process control to a subsea well via the marinized process control system based on input to the solid-state, processor based control from the plurality of sensors, wherein applying comprises adjusting power distribution to a plurality of devices.

12. The method as recited in claim 11, wherein applying comprises controlling a plurality of subsea pumps.

13. The method as recited in claim 12, wherein controlling comprises controlling a subsea electric submersible pumping system.

14. The method as recited in claim 12, wherein controlling comprises controlling a subsea booster pump.

15. The method as recited in claim 11, wherein applying comprises balancing power distribution to a plurality of load sources.

16. The method as recited in claim 11, wherein applying comprises controlling the frequency of a power signal.

17. The method as recited in claim 11, wherein applying comprises performing tree control.

18. The method as recited in claim 11, wherein applying comprises converting a power signal from alternating current to direct current.

19. The method as recited in claim 11, wherein applying comprises managing an equipment startup procedure.

20. A method of controlling the pumping of fluid in a subsea well, comprising:

deploying a subsea processor device proximate a plurality of subsea pumps to reduce latency effects;

controlling the plurality of subsea pumps with the subsea processor device;

optimizing power distribution to individual subsea pumps of the plurality of subsea pumps via the subsea processor device; and providing feedback to the subsea processor device to establish a subsea closed loop control.

21. The method as recited in claim 20, wherein controlling comprises controlling at least one submersible pump of an electric submersible pumping system and at least one subsea booster pump.

22. The method as recited in claim 20, wherein optimizing comprises balancing power distribution between the plurality of subsea pumps.

23. The method as recited in claim 20, wherein providing comprises obtaining information from a plurality of subsea sensors.

24. The method as recited in claim 20, wherein controlling comprises controlling a high-speed switch to provide electrical protection.

25. The method as recited in claim 20, wherein controlling comprises managing a start up and a shutdown procedure for at least one of the plurality of subsea pumps.

* * * * *